United States Patent [19]

Jennings

[11] 4,213,276

[45] Jul. 22, 1980

[54] BACK PACK GRINDING APPARATUS

[76] Inventor: Garman C. Jennings, 386 1/2 3rd St., Laguna Beach, Calif. 92651

[21] Appl. No.: 794,844

[22] Filed: May 9, 1977

[51] Int. Cl.[2] ..... B24B 23/02; A45F 3/04

[52] U.S. Cl. ..... 51/170 R; 30/296 R; 224/225

[58] Field of Search ..... 51/170 R, 170 PT, 170 T, 51/180, 427; 30/198, 296; 224/5 B, 5 BC

[56] References Cited

U.S. PATENT DOCUMENTS

| | | | |
|---|---|---|---|
| 1,486,140 | 3/1924 | Hickey | 30/198 X |
| 1,981,076 | 11/1934 | Sells | 224/5 B |
| 2,062,520 | 12/1936 | Mall | 51/170 |
| 3,214,869 | 11/1965 | Stryker | 51/273 |
| 3,219,129 | 11/1965 | Yamada | 30/296 |

FOREIGN PATENT DOCUMENTS

| | | | |
|---|---|---|---|
| 897324 | 11/1933 | Fed. Rep. of Germany | 51/170 R |
| 833853 | 7/1938 | France | 224/5 B |
| 1195454 | 5/1959 | France | 51/170 R |
| 239801 | 2/1946 | Switzerland | 51/170 R |

*Primary Examiner*—Nicholas P. Godici
*Assistant Examiner*—Roscoe V. Parker
*Attorney, Agent, or Firm*—Fulwider, Patton, Rieber, Lee & Utecht

[57] ABSTRACT

There is disclosed a portable grinding apparatus which includes a frame with straps and the like for mounting on the back of an operator. The frame supports a base plate carrying an electric motor which is connected through a flexible shaft to a hand-held abrating device, such as a grinding wheel and the like. The base plate, which supports the grinding motor, is rotatably mounted on the frame to permit shifting the abrating device between the operator's hands and the motor is covered with a housing which includes an exhaust fan for circulating a flow of air across the motor to provide comfort to the operator.

12 Claims, 7 Drawing Figures

BACK PACK GRINDING APPARATUS

BACKGROUND OF THE INVENTION

Field of the Invention

Portable grinding tools are customarily hand-held units and for this reason have limited torque and speed capability necessitated by the maximum weight that can conveniently be held in an operator's hands. A recent patent, U.S. Pat. No. 3,214,869, discloses a portable grinding apparatus in which the motor is mounted within a wheeled canister and connected through a flexible shaft to a hand-held grinding tool. While this structure is an improvement over the prior devices in that drive motors of higher torque and speed capability can be used than used in previous hand-held tools, the device is still limited since the canister-housed motor is cumbersome and limits freedom of movement of the operator.

SUMMARY OF THE INVENTION

This invention comprises a portable grinding apparatus in which the drive motor is mounted on a back-pack support frame and connected to a hand-held abrading tool by a flexible shaft. The back-pack frame comprises a pair of parallel standards interconnected by crossbars and bears harness means permitting its detachable mounting to the back of an operator. The frame has a support plate that rotatably carries a base plate on which the drive motor is attached. The base plate and drive motor are covered by an enclosure and lock means are provided on the frame to secure the base plate and enclosure against free rotation. The enclosure is provided with an exhaust fan to provide air circulation through the enclosed chamber, to provide a cooling air flow for the drive motor.

BRIEF DESCRIPTION OF THE DRAWINGS

The invention will be described with reference to the preferred embodiment shown in the figures of which.

DESCRIPTION OF THE PREFERRED EMBODIMENT

Figure 1:
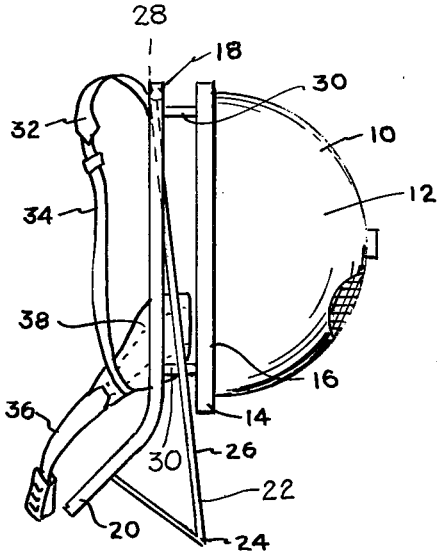
FIG. 1 is a side elevational view of the grinding apparatus.

Referring now to FIG. 1, the invention is illustrated as a housing 10 formed by a dome enclosure 12 which is attached to a support plate 14 that has a peripheral edge 16 and that is carried on a frame formed of a pair of parallel standards 18 which have a forwardly inclined lower end 20, as conventional in back-packs. The frame also includes an auxiliary frame 22 formed of a lowermost crossbar and upright parallel arms 26 which extend to an upper tubular crossbar 28 of the main frame. The main frame has a plurality of tubular posts 30 to which is attached the support plate 14 for the portable grinding apparatus. A crossbar 13 (see FIGS. 3 and 5) is provided at the lower portion of plate 14 and is secured to the main frame.

The support frame also has interconnectable strap means to permit securing the frame to the back of an operator. The interconnectable strap means includes an over-the-shoulder strap 32 carried at each side of the apparatus and secured to the upper tubular crossbar 28 with a dependent strap 34 extends to the lower portion of each parallel standard 20. The strap means also includes a wallet securing member defined by strap 36 which is attached to fabric band 38 of cushioning material designed to fit the small of the operator's back.

Figure 2:
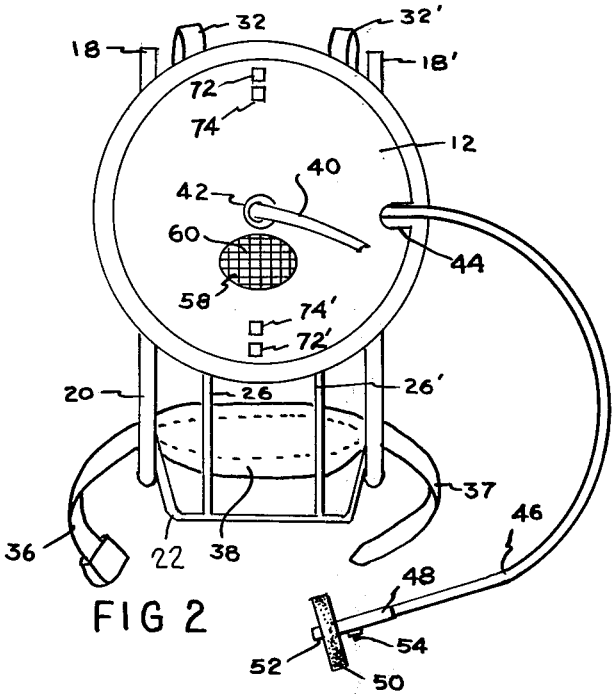
FIG. 2 is an elevational view of the back of the apparatus.

Referring now to FIG. 2, the apparatus is illustrated from the back side of the operator. The power supply for the grinding apparatus comprises an electrical cord 40 which enters the domed enclosure 12 through grommet 42. The dome 12 bares a peripheral, radial slot 44 which provides for exit of flexible shaft 46 from the drive motor contained within dome 12. The flexible shaft 46 extends to a hand grip 48 that is distally carried thereon and a grinding means such as grinding wheel 50 that is attached to the flexible shaft with a retaining nut 52. The hand grip 48 also bears remote switch 54 for operation of the motor.

The dome enclosure 12 is provided with ventilating means and has a ventilating port 58 which is covered by a grid or screen 60 to provide for discharge of the air circulated through the dome enclosure 12 during operation.

Figure 3:
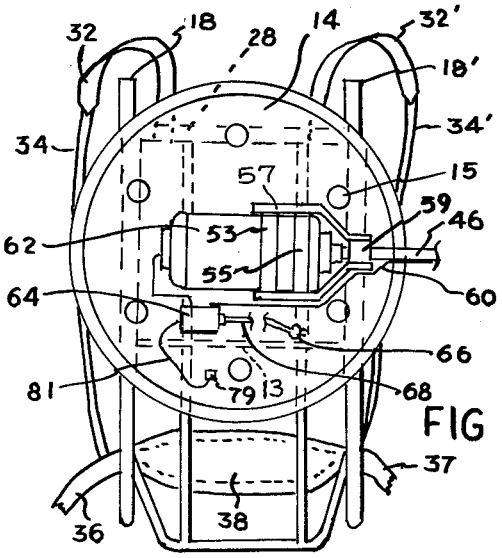
FIG. 3 is a back elevational view of the apparatus with the dome enclosure removed.
Figure 4:
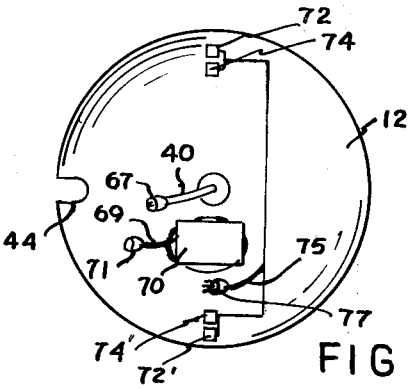
FIG. 4 is a view of the inside of the dome enclosure.

Referring now to FIG. 3, the apparatus is shown with the dome 12 removed. As there illustrated, the support plate 14 has a plurality of apertures 15 that are spaced about the plate to permit a circulating flow of air through the enclosure. The drive motor 62 is mounted on the support plate 14 at a central position and a relay 64 is provided for controlling the operation of the motor. The electrical cord 40 is provided with a disconnecting plug attachment 67 and 66; these elements are shown in FIGS. 4 and 3, respectively. A short length of the cord 68 extends to the relay box 64. A lead 60 also extends to relay box 64 and this lead is coextensive with the flexible shaft, extending to remote switch 54.

The flexible shaft 46 is provided with a support carried by the motor casing. This support comprises bearing and sleeve shaft support 59 which is distally carried by brackets 57 on opposite sides of the motor casing. Brackets 57 are secured by bands 53 and 55 which encircle the motor casing.

Referring to FIG. 4, the dome enclosure carries a ventilating means 70 in the form of an exhaust fan, and the like, having its own drive motor and connected through the relay box 64 by electrical lead 69 having a disconnectable plug 71 for connection in relay box 64.

The dome enclosure also supports a plurality of switch means 72 and 74 which are restart and reversing switches, respectively, and redundant switches 72' and 74', connected in parallel therewith. These switches are interconnected by conductor 73 and, through lead 75 and connector plug 77, are detachably connected to mating plug 79 on the end of conductor 81 which leads to relay box 64.

Figure 5:
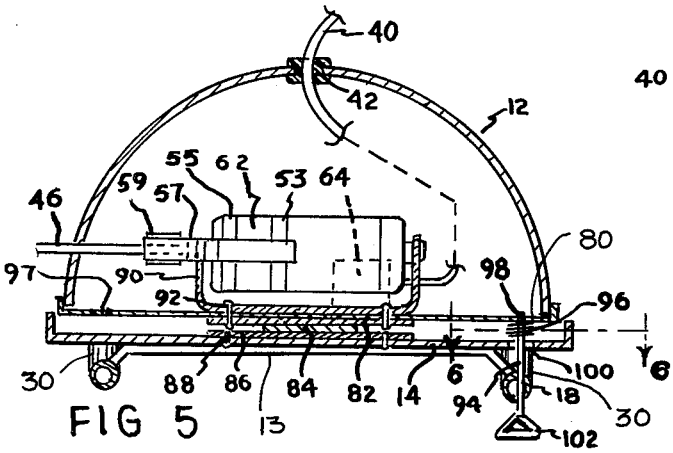
FIG. 5 is a sectional, elevational view of the apparatus.

Referring now to FIG. 5, the portable grinding apparatus is shown in a sectional view with the dome 12 secured to a base plate 80 which is carried on a central plate 82 that is secured to hub 84. The latter is rotatably mounted on auxilliary plate 86 which is attached to the support plate 14 with fasteners, such as rivets, machine screws 88 and the like. The motor 62 is mounted in a support cradle 90 of a generally U-shaped bracket having apertures to receive the mounting fasteners 92 which secure cradle 90, base plate 80 and central plate 82 in assembly. The frame also bears interlocking means to restrain or detent the rotational movement of the base plate 80 and associated dome 12. This comprises a pin 94 which is biased by spring 96 into a detenting position to seat in aperture 98 of the base plate 80. Pin 94 extends through an elongated aperture or slot 100 in the support plate 12 and through an aperture in the standard 18. A hand grip 102 can be provided on the end of pin 94.

Figure 6:
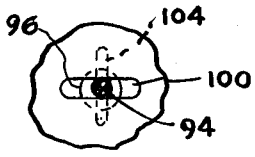
FIG. 6 is a view along the lines 6—6 of FIG. 5.

Referring now to FIG. 6, the elongated slot 100 is illustrated with pin 94 rotated 90° from the view shown in the FIG. 5 to reveal, in the hidden object lines, a crosspin 104 that is carried by pin 94 and that functions to serve as a key to restrain the detenting position of pin 94 when retrieved and rotated in the illustrated manner; the crosspin bearing against the support plate 14 and preventing further inward movement of pin 94.

Figure 7:
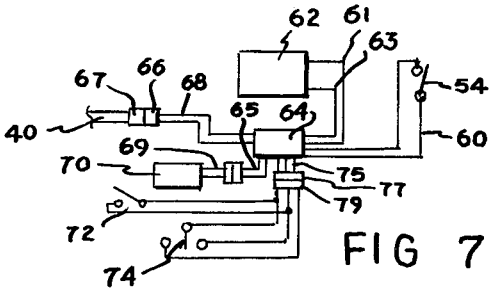
FIG. 7 is a schematic of the control circuit of the invention.

Referring now to FIG. 7, the electrical schematic of the grinding apparatus is illustrated. As there shown, electrical supply lead 40 is connected through mating connector plug 66 and 67 to lead 68 that extends to the relay box 64. The output of the relay box comprises conducting leads 61 and 63 which extend to motor 62. The conductor 60 which extends to remote switch 54, illustrated, and the interconnecting leads 69 and 65 are shown between the exhaust fan 70 and relay box 64. Also shown is the interconnecting lead 75 and 79 which extend between the reset switch means 72 and reversing switch means 74 and relay box 64.

The operation of the grinding apparatus of the invention is fairly apparent from the preceding description. The apparatus is intended for mounting on the back of an operator where it is removed from any possible obstruction with the work or hindrance of the free movement of the operator. The drive motor is mounted on a rotatable base plate thereby permitting the operator to freely shift the grinding tool assembly to either hand without requiring that the flexible shaft be passed in front of the operator. This is accomplished by the operator by disengaging the interlocking pin 94 that restrains free rotation of the domed enclosure, thereafter, rotating the flexible shaft and attached assembly from one side to the other and securing the assembly in the final desired position by seating the locking pin 94 in the appropriate aperture 97 or 98. The operator starts and stops the device using remote switch 54. When it is desired to reverse the rotation, the operator can reach behind his back and move the reset switch 74 or 74'. Since the switches are in parallel and are symmetrically positioned, the switch will be in the proper position regardless of the orientation of the motor and drive shaft on the support frame. A similar convenience is provided with the redundant parallel restart switch means 72.

The invention has been described with reference to the presently illustrated and preferred embodiment. It is not intended that the invention be unduly limited by this description of the preferred embodiment. Instead, it is intended that the invention be defined by the means, and their obvious equivalents, set forth in the following claims.

What is claimed is:

1. A portable grinding apparatus comprising:

a frame defined by parallel standards and interconnected cross bars with interconnectable strap means to permit securing said frame on the back of an operator;

a support plate peripherally secured to said frame;

a base plate rotatably mounted on said support plate and parallel thereto to permit its complete rotation in a plane substantially parallel to the back of said operator;

motor means secured to said base plate;

flexible shaft means extending from said motor to a remote distally attached abrasion means;

handle means distally carried on said flexible shaft means adjacent said abrasion means; and detachable lock means carried on said frame and engaging said base plate to fixedly secure said base plate against rotation whereby said base plate can be released to permit the operator to rotate said plate and shift said flexible shaft and abrasion means from side to side.

2. The apparatus of claim 1 also including motor actuation means remotely carried on said handle.

3. The apparatus of claim 1 herein said motor means is an electric motor with electric conducting cord means to connect said motor to a source of electrical energy.

4. The apparatus of claim 3 including reversing switch means in said circuit means for reversing rotation of said motor means.

5. The apparatus of claim 4 including overload breaker means and reset switch means in said circuit means.

6. The apparatus of claim 4 including circuit means with remote switch means carried on said handle to regulate the supply of electrical energy to said motor.

7. The apparatus of claim 4 including cover means surrounding said motor and removably attached to said base plate.

8. The apparatus of claim 4 including air circulation means to circulate a flow of air across said motor.

9. The apparatus of claim 4 including a support plate fixedly secured to said parallel standards and centrally bearing pivot means secured to said base plate.

10. The apparatus of claim 4 wherein said motor is centrally mounted on said base plate.

11. The apparatus of claim 4 wherein a pair of reversing switches are symmetrically located, one each on opposite sides of said base plate to provide a common location of said reversing switches, independent of the side-to-side position of said flexible shaft.

12. The apparatus of claim 7 wherein the electrical supply cord to said motor is secured to a central location on said cover means.

* * * * *